United States Patent [19]

Wright

[11] Patent Number: 4,717,050

[45] Date of Patent: Jan. 5, 1988

[54] MULTIPLE ORIFICE DISPENSING CLOSURE

[75] Inventor: David M. Wright, Evansville, Ind.

[73] Assignee: Sunbeam Plastics Corporation, Evansville, Ind.

[21] Appl. No.: 864,332

[22] Filed: May 19, 1986

[51] Int. Cl.[4] ..... B67D 3/00; B65D 47/00

[52] U.S. Cl. ..... 222/482; 222/486; 222/502; 222/532; 222/545; 220/259

[58] Field of Search ..... 222/502, 545, 536, 537, 222/531, 532, 481, 481.5, 486, 482–485, 487, 546; 220/256, 259, 86 AT; 73/428, 866.5

[56] References Cited

U.S. PATENT DOCUMENTS

| | | | |
|---|---|---|---|
| 1,977,935 | 10/1934 | Caldwell | 220/86 AT |
| 1,978,314 | 10/1934 | Lancaster | 220/259 X |
| 2,753,051 | 7/1956 | Tupper | 220/259 X |
| 3,204,829 | 9/1965 | Song | 222/484 X |
| 3,220,619 | 11/1965 | Lodding et al. | 222/545 X |
| 3,409,188 | 11/1968 | Wright | 222/565 X |
| 4,503,991 | 3/1985 | Joyce | 229/44 R X |
| 4,545,508 | 10/1985 | Cribb, Jr. et al. | 222/545 X |

FOREIGN PATENT DOCUMENTS

| | | | |
|---|---|---|---|
| 88029 | 7/1956 | Norway | 222/565 |

*Primary Examiner*—Joseph J. Rolla
*Assistant Examiner*—Gregory L. Huson
*Attorney, Agent, or Firm*—Irvin L. Groh; Alfred L. Patmore, Jr.

[57] ABSTRACT

A multiple orifice closure for attachment to a container for dispensing product, usually in the form of a liquid, at different rates. The closure includes a cap incorporating the larger orifice and an annular skirt having a container attachment such as threads or a snap bead. Two lids are hinged to the closure; one is an intermediate lid which covers the cap top and contains the second smaller orifice. The other lid is a top lid which acts to close the smaller orifice on the intermediate lid.

16 Claims, 7 Drawing Figures

MULTIPLE ORIFICE DISPENSING CLOSURE

This invention relates to a dispensing closure for containers, and, more particularly, to a multiple orifice closure.

There are a wide variety of dispensing closures which are provided with a single dispensing orifice in a cap and a hinged lid to close the orifice. A number of these closures are designed to have the cap more or less permanently attached to the container so that the container contents must be removed through the single dispensing orifice. Examples of this type of closure are shown in Montgomery and McAlinden, U.S. Pat. No. 4,371,095 and in Luker, U.S. Pat. No. 4,378,073. Since this type of cap is designed for permanent attachment to the container, removal of the cap for rapid dispensing directly from the container is impossible. Even where the cap is threaded such as that in Bush U.S. Pat. No. 4,261,486, removal of the cap for dispensing large quantities, at best, is impractical.

Likewise, closures designed for dispensing solid material in the form of a powder or granule type material such as spices, either by shaking through a group smaller orifices or in the bulk by an opening which provide access to the container with an instrument such as a spoon, it does not provide a satisfactory solution for dispensing liquids at two different rates. For example, Bush and Gach, U.S. Pat. No. 4,284,200 shows such a closure having a perforated segment for shaking dispensing and a clear opening segment for spoon dispensing, closed by separate lids in a single plane. This structure would not lend itself to dispensing a liquid without spillage problems over the balance of the closure including the opened lid.

It is, therefore, an object of this invention to provide a closure for dispensing a liquid product through separate dispensing orifices of different sizes.

It is another object of this invention to provide a closure having multiple orifices in which the orifices are covered by independent lids hinged to the closure.

It is still another object of this invention to provide a multiple orifice, multiple lid closure in which the lids may be formed or molded integrally with their hinges as part of the closure as shown in the aforementioned patents, or where the lids may be molded separate from the base cap and provided with a take apart hinge to aid cleaning for repetitive use such as the two piece hinge structure shown in U.S. patent application, Ser. No. 825,464 filed in the name of Bush for a Two Piece Dispensing closure now U.S. Pat. No. 4,666,068.

The foregoing objects and other advantages of the present invention are accomplished in a multiple orifice dispensing closure having a base cap, a hinged intermediate lid which closes in abutment to the top of the cap and a top lid for closure over the intermediate lid.

The cap is formed with a flat top with a first dispensing orifice which extends therethrough. The cap has a cylindrical skirt which has means for attachment to a container such as internal threads which engage complementary threads on the neck of a container. The first orifice is the larger orifice for dispensing greater quantities of produce. An intermediate lid is hinged to the cap and contains a second, smaller diameter orifice of dispensing the produce at a lower rate. A top lid is provided which is hinged to the closure either to the intermediate lid or the cap for closure of the second orifice. With this arrangement, the intermediate lid may be swung open for dispensing the large quantity through the first orifice. The top lid can be swung open with the intermediate lid seated in abutment on the cap for dispensing a lower quantity of product. both of the orifices are closed when the intermediate lid is seated on the cap and the top lid is seated on the intermediate lid.

In one embodiment, only the larger first orifice extends through the top of a base cap, and the second smaller orifice extends through the intermediate cap aligned with the area of the first orifice when the intermediate lid is seated on the cap so that dispensing from the second orifice occurs by flow from the container through the first orifice and out of the second orifice. To assure continuity of flow between the first and second orifices and to provide self cleaning closing of the first orifice, a tubular plug depends from the intermediate lid surrounding the second orifice for engagement with the first orifice on the cap when the intermediate lid is seated on the cap. This also provides a means for maintaining this seating of the intermediate cap in abutment on the top of the cap. The top lid closes the second orifice thus closing the container to which the closure is attached. To provide a self-cleaning closure and providing a means for maintain the top lid in its closed position seated in abutment on the intermediate lid, a stopper is provided depending from the top lid for engagement with the second orifices when the top lid is seated on the intermediate lid.

To provide a pleasingly aesthetic appearance with no irregular part lines when the lids are in their closed position, the intermediate and top lid can be provided with annular skirts of the same diameter as the cap skirt. The cap top is provided with a peripherial recess which is engaged by the annular skirt of the intermediate lid and the top of the intermediate lid is provided with a peripheral recess which is engaged by the annular skirt of the top lid to maintain the lids and the cap in seated abutment with each other.

In another embodiment, the cap top is provided with a first, larger diameter dispensing orifice and a third, smaller diameter orifice which acts as an air vent when product is dispensed through the first orifice. The intermedite lid is provided with the second orifice which is aligned with the area of either the first or third orifices on the base cap. In the preferred form, the second orifice is aligned with the smaller air vent, third, orifice on the base cap. The intermediate lid is further provided with a plug which is aligned with the second orifice and depends from the lid for engagement with the third, air vent, orifice on the cap top when the intermediate lid is seated on the cap. The plug has a passage through it for communication with the container through the third orifice and in communications with the second orifice for dispensing of the smaller quantity of produce therethrough. Also depending from the intermediate cap is a second plug which engages the first larger orifice for closure thereof. As in the previously embodiment, a stopper is provided on the top lid for engagement with the second orifice when the intermediate lid is in seating abutment with the base cap and the top lid is in seating abutment with the intermediate lid. The larger first orifice and the third air vent orifice are formed along an axis which is parallel to the hinge axis between the cap and intermediate lid to allow the intermediate lid to be swung completely out of interference for dispensing with the larger orifice in a vertically lower position and the air vent orifice in the vertically upper position as the container and closure is tilted for dispensing. The top lid is hinged to the intermediate lid at right angles to the axis of the first and third orifices and is located at the farthest side from the second orifice to provide an opening movement of the top lid completely out the dispensing line from the second orifice.

The presently preferred embodiment of the invention are illustrated in the accompanying drawing in which.

Figure 1:
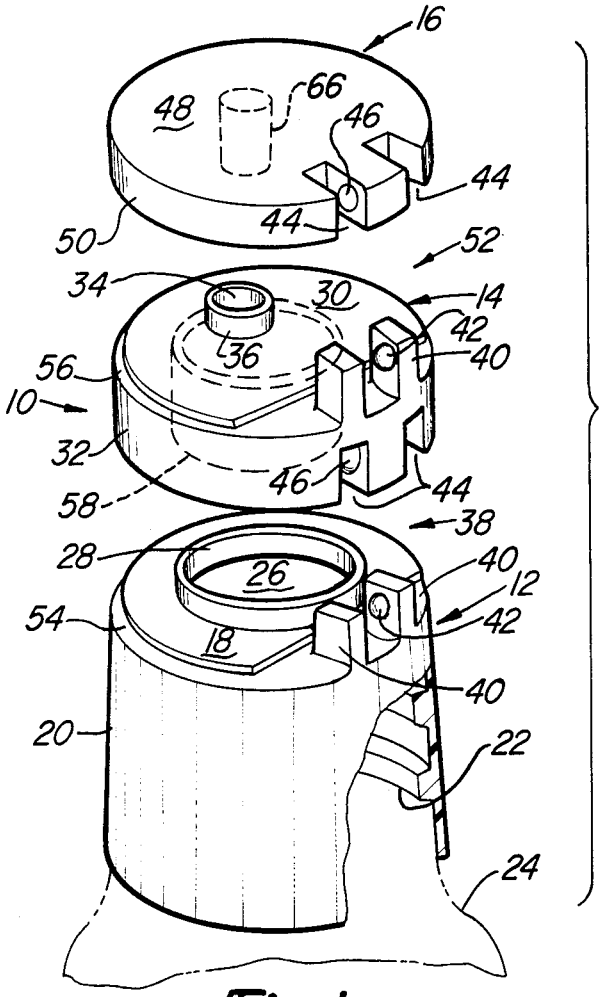
FIG. 1 is an exploded perspective view of the multiple orifice dispensing closure of this invention in which a single larger orifice is formed in the top of the base cap and a smaller dispensing orifice is contained in the intermediate lid, separable dual post hinges being used for joining the lids and base cap.
Figure 5:
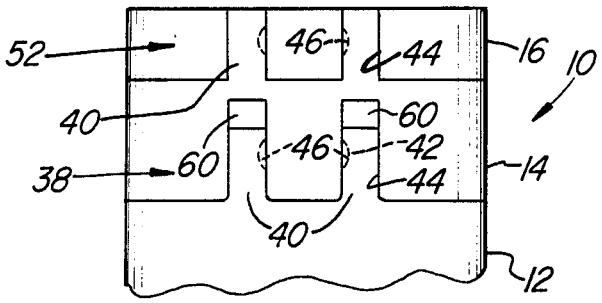
FIG. 5 is a partial elevational view showing the alignment of the hinge between the intermediate lid and cap and the hinge between the intermediate lid and top lid.
Figure 6:
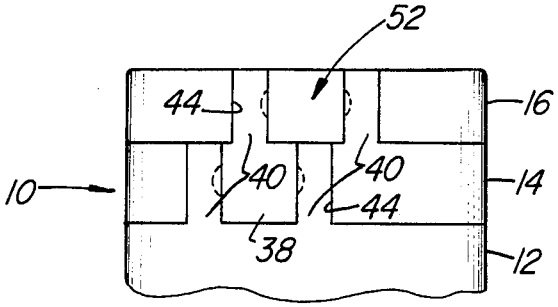
Figure 7:
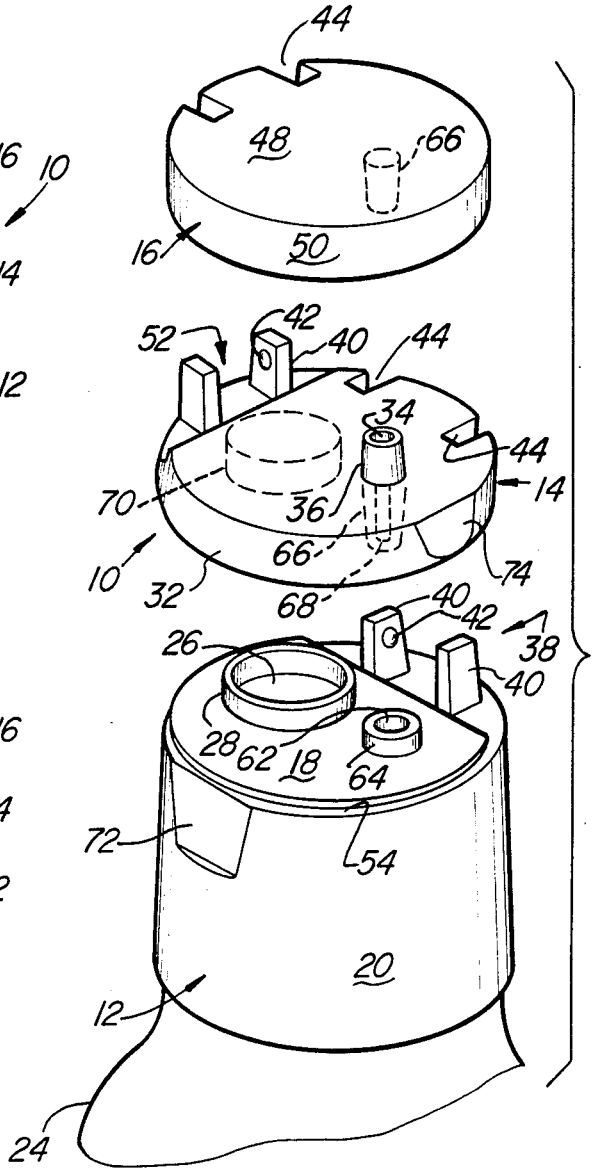

FIG. 6 is a fragmentary elevational view similar to FIG. 5 showing another embodiment in which the hinges are slightly out of alignment to accommodate proper swinging clearance of the lids with a minimum thickness for the intermediate lid; and FIG. 7 is an exploded perspective view similar to FIG. 1 of another embodiment of the invention in which an air vent is also supplied on the cap top along with the larger diameter dispensing orifice.

Referring to FIG. 1, closure 10 is shown as including three separable parts: base cap 12, intermediate lid 14, and top lid 16. Cap 12 is formed with a flat top 18 and a depending annular skirt 20 having internal threads 22 for engaging complementary threads, not shown for clarity, for attachment of the closure 10 to container 24.

The larger of two dispensing orifices 26 is shown extending through cap top 18 with an upperly extending annular rim 28 forming a nozzle or pouring lip for orifice 26.

Intermediate lid 14 is formed with a flat top 30 and depending annular skirt 32. Smaller orifice 34 extends through top 30 in alignment with the area of the larger orifice 26. An upstanding annular rim 36 around the periphery of orifice 34 forms a suitable nozzle or pouring lip. Hinge 38 between cap 12 and intermediate lid 14 is formed as a dual post structure as more fully set forth in the aforementioned patent application, Ser. No. 825,464. Cap 12 has a pair of upwardly extending posts 40 adjacent to its perimeter and each post has a spherical projection 42 facing inwardly toward the projection on the other post 40. Intermediate lid 14 is provided with a pair of complementary slots 44 opening at the bottom and periphery of the lid and having walls formed with spherically concave indentations 46 facing each other. The slots 44 are aligned to receive the post 40 while the spherical projections 42 snap into spherical indentations 46 forming a swinging hinge axis through the center of the projections.

Top lid 16 is formed with a top surface 48 and a depending annular skirt 50. The hinge 52 between the intermediate lid 14 and top lid 16 is formed in the same manner as hinge 38 having hinge posts 40 with facing spherical projections 42 on the intermediate cap 14 and complementary slots 44 with spherical indentations 46 located on the top lid 16.

Figure 2:
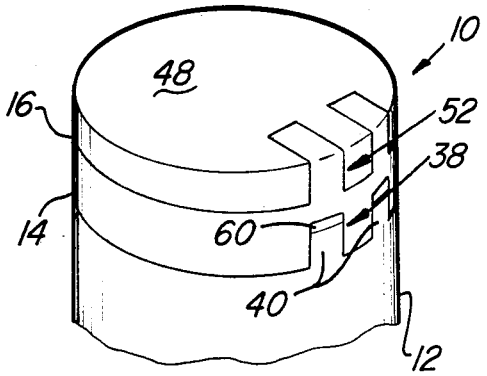
FIG. 2 is a fragmentary perspective view of the closure of FIG. 1 showing it in its sealed, closed position with the intermediate lid seated in abutment on the base cap and the top lid seated in abutment on the intermediate lid.

FIG. 2 shows the closure in the assembled position with both dispensing orifices sealed or closed. Hinge 38 allows intermediate lid 14 to swing into a seated position in closing abutment with top 18 of cap 12, and hinge 52 allows top lid 16 to swing into a seated position in closing abutment with intermediate lid 14.

Top 18 of cap 12 is formed with a peripheral recess 54 which accepts and retains the annular skirt 32 of intermediate lid 14 in a closed seated position. Likewise, top 30 of intermediate lid 14 is formed with a peripheral recess 56 which accepts the annular skirt 50 of top lid 16 in seated, abutting relationship.

Intermediate lid 14 is formed with a depending tubular plug 58 which encompasses orifice 34 and engages orifice 26 in cap top 18 when the intermediate lid 14 is seated in closing abutment on cap 12. The engagement of plug 58 in orifice 26 will hold the intermediate lid 14 seated on cap 12 independent of or in cooperation with the coaction of intermediate lid skirt 32 and cap recess 54. Tubular plug 58 supplies fluid communication of the product being dispensed from container 24 through orifice 26 and out smaller orifice 34. Plug 58 also acts as a self-cleaning closure stopper.

Top lid 50 is formed with a depending plug or stopper 60 which engages smaller orifice 34 when the top lid 16 is in seating abutment with intermediate lid 14. Together, plugs or stoppers 58 and 60 seal the closure orifices.

Figure 4:
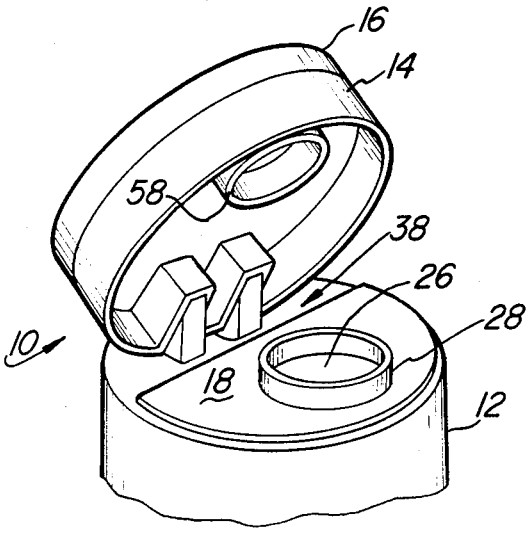
FIG. 4 is a fragmentary perspective view similar to FIGS. 2 and 3 showing the closure of FIG. 1 in position for dispensing through the larger orifice in the base cap with the intermediate and top lid in seated abutting relationship to each other.

FIG. 4 shows the top lid 16 and intermediate lid 14 in an open position with larger orifice 26 in dispensing positions by the withdrawal of tubular plug 58. While the lids 14 and 16 are shown in a partially open position, they can be swung into a 180 degree fully opened position as more fully explained in the aforementioned patent application.

Figure 3:
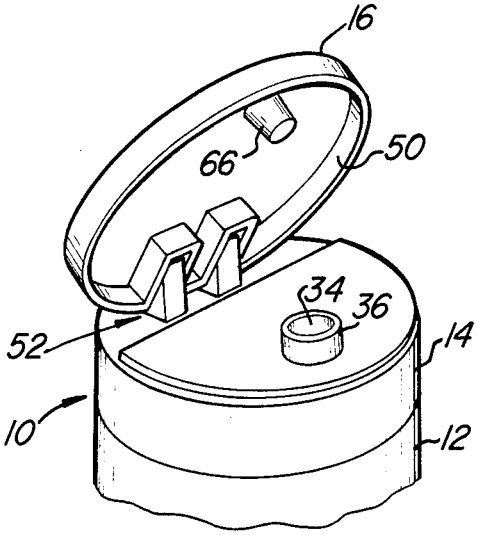
FIG. 3 is a fragmentary perspective view similar to FIG. 2 showing the closure of FIG. 1 in position for dispensing through the smaller orifice as the top lid is open and the intermediate lid is in seated abutment with the cap.

FIG. 3 shows intermediate lid 14 seated on cap 12 for the use of smaller orifice 34 as sealing plug 60 has been withdrawn by opening of top lid 16. Likewise, lid 16 can be swung into a full 180 degree fully opened position.

As shown in FIGS. 2 and 5, with the hinges 38 and 52 in vertical alignment, sufficient space 60 must be provided in slots 44 at the top of post 40 for swinging clearance. If the hinges 38 and 52 are moved out of vertical alignment by slightly more than the width of posts 40, and the slots 44 extended to the top of intermediate lid 14, sufficient swinging clearance is provided with an intermediate lid 14 which is not as thick as one in which the hinges are aligned.

In the embodiment shown in FIG. 7, the top 18 of cap 12 is formed with an additional smaller orifice 62 which acts as an air vent when dispensing takes place through the larger orifice 26. Like orifice, air vent 62 is provided with an annular rim 64 around the orifice 62 which serves to provide an extended gripping area for depending plug 66 rather than as a pouring lip. The larger dispensing orifice 26 and the air vent 62 are on a center line which is parallel to the swinging axis of hinge 38 through the spherical projections 42 on post 40. The smaller dispensing orifice 34 located on intermediate lid 14 can be in line with either the air vent orifice 62 or the larger orifice 26 in cap top 18. Typically, the smaller orifice 34 would be in line with air vent orifice 62 and have depending plug 66 in line with orifices 34 and 62 for engagement with orifice 62 and annular rim 64. Plug 66 has passage 68 extending axially therethrough to provide fluid communication between orifice 62 and dispensing orifice 34. Additional plug 70 depends downwardly from intermediate lid 14 to engage orifice 26 and annular rim or pouring lip 28 to close the larger orifice when the intermediate lid 14 is in abutting, seating position on cap 12. In this embodiment, hinge 52 is at right angles to hinge 38 and located on the far side of orifice 34 to provide maximum swinging engagement of plug or stopper 60 with orifice 34.

With depending annular skirt 50 of top lid 16 merging into the perimeter of intermediate cap 14, that is, depending annular skirt 32, and annular skirt 32 of intermediate lid 14 merging into the perimeter of base cap 12, that is, depending annular skirt 20, means must be provided for independently opening intermediate lid 14 and top lid 16. In both the embodiments of FIG. 1 and FIG. 7, this can be accomplished by indentations opposing the hinges. Referring specifically to FIG. 7, cap 12 is provided with an indentation or notch 72 in skirt 20 which can be of uniform depth or beveled inwardly toward the top of the cap. Indentation 72 is most suitably located on a line through the center of hinge 38; this allows the user to grip the bottom of intermediate lid 14 and swing it into an open position.

Likewise, intermediate lid 14 is provided with an indentation 74 in skirt 32 located opposite hinge 52. As seen in FIG. 7, notch 74 is on a diametric line with orifice 34 and hinge 52, allowing the user to grip the bottom of top lid 16 and swing it into an open position.

While the preferred embodiments of the invention are shown with separately molded lids joined by snap post hinges, it will be appreciated that integrally formed live hinges or web hinges may be substituted for hinge 38 between cap 12 and intermediate lid 14 and hinge 52 between the intermediate lid and top lid 16. Also top lid 16 may be hinged to cap 12 by a strap hinge instead of to intermediate lid 14.

What is claimed is:

1. A multiple orifice dispensing closure for dispensing product at different rates from a container comprising, in combination: a cap having a flat top with a first dispensing orifice extending therethrough and a cylindrical skirt having means for attachment to a container; an intermediate lid hinged to said cap with a second orifice extending therethrough; and a top lid hinged to one of said intermediate lid and cap for closure of said second orifice whereby said intermediate lid may be swung open for dispensing through said first orifice, said top lid can be swung open with said intermediate lid seated on said cap for dispensing through said second orifice, said second orifice being smaller than said first orifice and aligned with the area of said first orifice when said intermediate lid is seated on said cap; and a tubular plug depending from said intermediate lid surrounding said second orifice and engaging said first orifice when said intermediate lid is seated on said cap so that the dispensing from said second orifice occurs by flow from said container, through said first orifice, and out of said second orifice, and both of said orifices being closed when said intermediate lid is seated on said cap and said top lid is seated on said intermediate lid with said plug in engagement with said first orifice.

2. The dispensing closure of claim 1 further comprising a stopper depending from said top lid for engagement with said second orifice when said top lid is seated on said intermediate lid, said tubular plug and said stopper acting to close both dispensing orifices when said top lid is seated on said intermediate lid and said intermediate lid is seated on said cap.

3. The dispensing closure of claim 1 wherein said intermediate lid has a depending annular skirt, and said cap top has a peripheral recess which said intermediate lid skirt engages maintaining said intermediate lid in a seated position on said cap.

4. The dispensing closure of claim 3 further comprising a tubular plug depending from said intermediate lid for engagement with said first orifice, which together with said annular skirt and recess, maintain said intermediate lid seated on said cap.

5. The dispensing closure of claim 3 wherein said intermediate lid has a peripheral recess opening upward and said top lid has an annular skirt which engages the recess in said intermediate lid maintaining said intermediate lid in a seated position on said cap.

6. The dispensing closure of claim 5 wherein said top lid has a depending stopper for engagement with said second orifice, which together with said top lid skirt and intermediate lid recess, maintains said top lid seated on said intermediate lid.

7. The dispensing closure of claim 1 including a third orifice extending through said cap top and acting as an air vent as product is dispensed through said first orifice.

8. The dispensing closure of claim 7 wherein said second orifice is aligned with the area of one of said first and third orifices so that dispensing from said second orifice occurs by a flow from said container through one of said first and third orifices and out said second orifice.

9. The dispensing closure of claim 8 wherein said second orifice is aligned with said third orifice for dispensing product from said container through said third orifice and out said second orifice when said intermediate lid is seated on said cap.

10. The dispensing closure of claim 9 further comprising a plug aligned with said second orifice and depending from said intermediate lid for engagement with said third orifice when said intermediate lid is seated on said cap, said plug having a passage therethrough for communication with said container through said third orifice and in communication with said second orifice for dispensing therethrough.

11. The dispensing closure of claim 10 further including a second plug depending from said intermediate lid in alignment with said first orifice for closure of said first orifice when said intermediate lid is seated on said cap.

12. The dispensing closure of claim 11 further including a stopper depending from said top lid for engagement with said second orifice when said top lid is seated on said intermediate lid.

13. A multiple orifice dispensing closure for a dispensing product at different rates from a container comprising, in combination: a cap having a top with a first dispensing orifice extending therethrough and a cylindrical skirt having means for attachment to a container; an intermediate lid hinged to said cap with a second orifice smaller than said first orifice extending therethrough in alignment with the area of said first orifice when said intermediate lid is seated in abutment with said cap; a tubular plug depending from said intermedite lid surrounding said second orifice and engaging said first orifice when said intermediate lid is seated on said cap; and a top lid hinged to said intermediate lid for closure of said second orifice when said top lid is seated in abutment with said intermediate lid, whereby said intermediate lid may be swung open for dispensing a relatively larger quantity of product through said first orifice, said top lid can be swung open with said intermediate lid seated on said cap for dispensing a relatively smaller quantity of product through said second orifice, and both of said orifices can be closed by seating said intermediate lid on said cap and seating said top lid on said intermediate lid with said plug in engagement with said first orifice.

14. The dispensing closure of claim 13 wherein the hinging between said intermediate lid and said cap is in line with the hinging between said top lid and said intermediate lid.

15. A multiple orifice dispensing closure for dispensing products at different rates from a container comprising, in combination: a cap having a flat top with a larger and a smaller dispensing orifice extending therethrough and a cylindrical skirt having means for attachment to a container; an intermediate lid having an opening therein and having a nozzle extending therefrom and aligned with one of the larger and smaller orifices for dispensing product therethrough; and a top lid hinged to said intermediate lid for closure of said nozzle; whereby said intermediate lid may be swung open for dispensing a relatively larger quantity of product through said larger orifice as said smaller orifice acts as an air vent, said top lid can be swung open with said intermediate lid seated on said cap for dispensing a relatively smaller quantity of product through said nozzle, said orifices and nozzle being closed when said intermediate lid is seated on said cap and said top lid is seated on said intermediate lid.

16. The dispensing closure of claim 15 wherein said intermediate lid is hinged to said cap along a hinge axis parallel to said cap top and said larger and smaller orifices are aligned along an axis parallel to said hinge axis and said top lid is hinged to said intermediate lid along a hinge axis perpendicular to said orifice axis.

* * * * *